US006595151B2

(12) United States Patent
Keller

(10) Patent No.: US 6,595,151 B2
(45) Date of Patent: Jul. 22, 2003

(54) PLANING SAILBOARD

(75) Inventor: John H. Keller, Newburgh, NY (US)

(73) Assignee: K2 Keller Consulting, Newburgh, NY (US)

( * ) Notice: Subject to any disclaimer, the term of this patent is extended or adjusted under 35 U.S.C. 154(b) by 0 days.

(21) Appl. No.: 09/867,437

(22) Filed: May 31, 2001

(65) Prior Publication Data

US 2002/0178984 A1 Dec. 5, 2002

(51) Int. Cl.[7] ..... B63B 35/00
(52) U.S. Cl. ..... 114/39.14; 441/74
(58) Field of Search ..... D21/769; 441/65, 441/74, 79; 114/39.14, 291, 67 A

(56) References Cited

U.S. PATENT DOCUMENTS 3,160,897 A * 12/1964 Kelly, Jr. ..... 441/74
3,747,138 A * 7/1973 Morgan ..... 114/291
D258,516 S * 3/1981 Slingerland ..... D21/769

FOREIGN PATENT DOCUMENTS

FR 652311 * 3/1929 ..... 114/291
WO WO 90/03306 * 4/1990 ..... 114/39.14

* cited by examiner

*Primary Examiner*—Ed Swinehart
(74) *Attorney, Agent, or Firm*—Whitham, Curtis & Christofferson, P.C.

(57) ABSTRACT

High performance of a sailboard is achieved over a wider range of wind and water conditions by providing a hull having two or more planing surfaces which may differ in shape and/or aspect ratio. Drag due to suction at steps between planing surfaces is reduced by venting to the air. Cusp shaping of the respective planing surfaces can reduce and stabilize the angle of attack at the displacement/planing transition without causing fore-and-aft pitching effects known as porpoising.

21 Claims, 6 Drawing Sheets

PLANING SAILBOARD

BACKGROUND OF THE INVENTION

1. Field of the Invention

The present invention generally relates to planing hulls for watercraft and, more particularly, to planing hulls for sailboards/windsurfers for improving the transition from displacement operation to planing operation and exhibiting increased speed over a wider range of wind speed.

2. Description of the Prior Art

Hulls of watercraft may be of either of two distinct types: a displacement hull which derives vertical lift from the weight of water displaced by the hull and a planing hull which derives vertical lift from thrusting water downwardly by the bottom surface of the hull when in motion. At rest or at low speed, planing hulls function in the same manner as displacement hulls. Displacement hulls are most efficient and derive greatest speed for a given amount of power if they are a long and narrow, streamlined shape. Planing hulls, on the other hand can be much more efficient than displacement hulls when planing and, since lift is derived from the angle of attack between the bottom surface of the hull and the water surface, are most efficient if wide and short; directly conflicting with the preferred shape for displacement hulls.

Therefore, in general, the more fully a hull is optimized for planing efficiency, the more power is required to reach planing speed. It follows that planing hulls must often represent a compromise between efficiency in the displacement and planing modes of operation, particularly where available motive power is limited such as when sails are employed. Conversely, wind/sail-powered watercraft such as sailboards generally operate well only within a narrow range of wind conditions.

For example, commercially available sailboards such as the Mistral Ultralight and the F2 race board are made for non-planing or marginal planing conditions and are long, narrow and streamlined but, as would be expected, do not plane well and are not as fast as planing "slalom" or short boards. For example, some boards like the commercially available Pro-Tech C. A. T. are wide and short and very fast when planing but comparatively slower at displacement operation speeds in light winds. Such short boards are also somewhat more difficult to control and "unfriendly" to inexperienced wind surfers. Other boards which are short and narrow are fast when planing because they achieve the proper attack or planing angle but require more wind to achieve planing.

Other factors in board design also affect performance in a variety of conditions, particularly in regard to planing. For example, if a board is flat, it will plane in lower wind but tends to ride "hard" under conditions of even a slight chop (e.g. wind driven small waves) If it is large so that it planes in low wind, it is not as fast in higher winds because it will assume too small an angle of attack. If the bottom of the board has a V-shape, it will ride more smoothly but will not plane as fast (e.g. requires more wind to achieve planing). The board will also ride more smoothly if it has more "rocker" (e.g. curvature front-to-rear). It will be faster when not planing and may be faster when planing in high wind due to reduction in wetted area. However, increased "rocker" makes it plane more slowly and requires additional wind for planing due to the decreased angle of attack at the rear which may even cause suction where the bottom surface tries to leave the water. Thus, increased rocker is generally desirable in displacement hulls while decreased, if any, rocker is desirable in planing hulls.

Commercially available boards which are designed primarily to perform in light wind are generally too flat to perform well in higher wind. Such boards are more flat and plane at an angle of attack less than the optimum 40°–70°; thus having increased wetted surface and associated drag.

In this regard, it is known for relatively small motor boats (having a significant degree of rocker) to install trim plates extending behind the transom or stern of the boat which can be deflected slightly downwardly to provide lift at the stern of the boat and thus increase the stern angle of attack when the hull is beginning to plane. The trim plates thus reduce power requirements and smooth the transition between displacement and planing modes of operation. However, it is not practical to use such expedients on a sailboard since control by the operator is impractical.

Further, for both boats and sailboards, such trim plates or hull shaping to the same purpose (which is effectively contrary to the function of rocker), if not properly set for the current speed, can cause an effect known as porpoising. Porpoising is an unstable state in which excess lift at the rear or stern forces the bow lower in the water where rocker causes increased lift at the bow; resulting in an oscillatory pitching action and increased drag. Moreover, with sailboards, some of the deleterious effects of excessive rocker, such as increased angle of attack can be ameliorated by alteration of fore and aft balance at the displacement/planing transition by a suitably skilled operator.

Planing hulls may also be of either the stepped or unstepped types. While the latter has a substantially continuous lower surface, the former, stepped type has an upward step or recess in the bottom surface which is either in front of the center of gravity or very small. This step, under planing conditions at relatively high speed, reduces the wetted surface and associated drag. However, the discontinuity in the shape of the bottom surface also tends to increase drag (for reasons that have not previously been well-understood but intuitively thought to be related to a combination of turbulence and suction behind the step and deeper extension into the water) during displacement mode operation and increase the difficulty of the transition between displacement and planing conditions as well as increasing the power/speed required to reach planing conditions.

Possibly for this reason, stepped bottom surfaces are not generally used for sailboards. Among currently commercially available designs, only the Pro-tech C. A. T., which has an approximately one-half inch step near the rear of the board, provides a stepped bottom surface rather than a single running or planing bottom surface. Further, the step is either completely surrounded by water (during displacement operation) so it only functions as a step in the mainly displacement mode (low speed planing or slower) or completely out of the water (during planning operation).

In summary, while numerous design features of watercraft hull shapes are known for enhancement of efficiency and performance, each such feature and most combinations thereof have tended to narrow the range of conditions under which such enhancement can be realized. These limitations are particularly critical where available power is limited as is the case with sailboards which operate solely under sail power and where the sail area is severely limited by the necessity of being held in place by a human operator, principally by balancing wind force with limited body weight.

Further, good planing performance is of high importance with sailboards since high speed is very desirable in the windsurfing sport and less power is required while planing, as alluded to above. Moreover, the speed increase which occurs when planing is achieved greatly increases apparent wind speed during reaches (sailing generally across or toward the wind), allowing substantial increase in the speed attainable as well as generally increased maneuverability. Nevertheless, known designs of sailboard hulls only support such levels of performance within a limited range of conditions (e.g. wind speed, water surface chop, and the like) while the cost and size of sailboards and other practical considerations effectively prevent alternative use of sailboards of different designs to exploit particular conditions which may prevail at any given time. Nevertheless, known designs of sailboard hulls only support such levels of performance within a limited range of conditions (e.g. wind speed, water surface chop, and the like) while the cost and size of sailboards and other practical considerations effectively prevent alternative use of sailboards of different designs to exploit particular conditions which may prevail at any given time.

SUMMARY OF THE INVENTION

It is therefore an object of the present invention to provide a hull design, particularly for a sailboard, which has high planing performance and can reach a planing mode of operation over a wide range of wind speed.

It is another object of the invention to provide a hull design which has a stable and consistent angle of attack when planing over a wide range of wind speed.

It is a further object of the invention to provide a sailboard hull having a stepped lower surface that reduces difficulty of the transition from displacement to planing operation and avoids other observed undesirable effects such as increased drag during displacement operation.

In order to accomplish these and other objects of the invention, a sailboard apparatus and hull thereof is provided including a first planing surface, a second planing surface extending below the first planing surface and forming a step at a juncture of the first planing surface and a rear portion of the second planing surface, and an arrangement for reducing suction behind the second planing surface including, for example a vent to or through the top surface of the sailboard hull or to the side of the sailboard hull above the surface of water supporting the sailboard hull or streamlining of the second surface.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
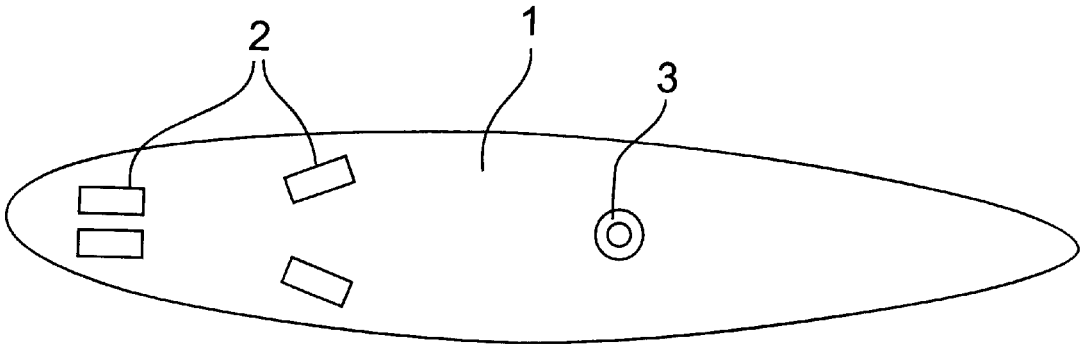
Figure 1A RELATED ART
FIGS. 1A, 1B, and 1C are generalized top, side and bottom views, respectively, of a sailboard omitting salient features in accordance with the invention for reference purposes.
Figure 1B:
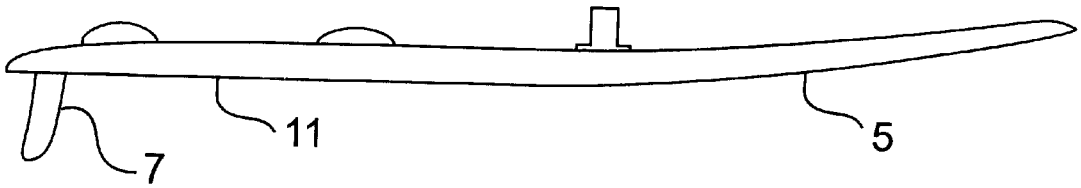
Figure 1B RELATED ART
Figure 1C:
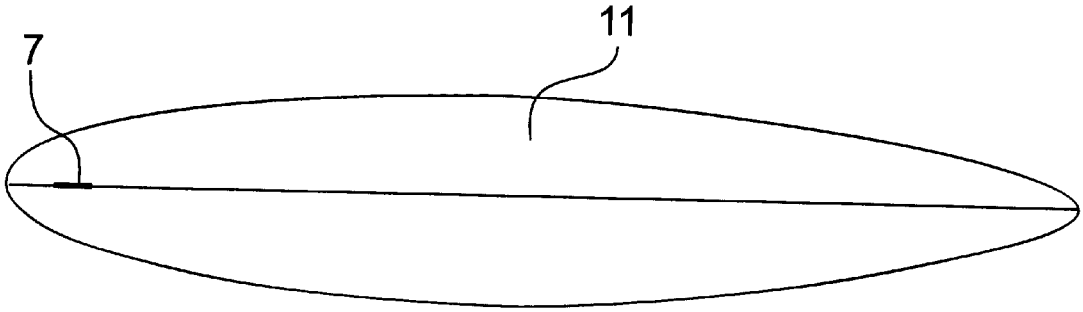
Figure 1C RELATED ART

Referring now to the drawings, and more particularly to FIGS. 1A–1C, there are shown top, side and bottom views, respectively, of a generalized sailboard hull 1 which, for reference, does not include all features in accordance with the invention in its various forms and embodiments. Since FIGS. 1A–1C are generalized and arranged for illustrative purposes, however, no portion of these Figures is admitted to be prior art as to the present invention. The overall shape in the top or plan view of FIG. 1A is generally elliptical but may be slightly more pointed at the front or rear. Foot straps 2 and a sail or mast foot (generally gimballed) are installed on the upper surface of as shown in FIGS. 1A and 1B. A gentle upward curve or "rocker" is illustrated in the side view of FIG. 1B at reference numeral 5. A fin 7 is shown extending from the bottom surface 11 of the board in the side and bottom views of FIGS. 1B and 10. The bottom side of the board, as shown in FIG. 10, is also shaped in the form of a very shallow "V" as is sometimes a feature of commercially available sailboards.

Figure 2A:
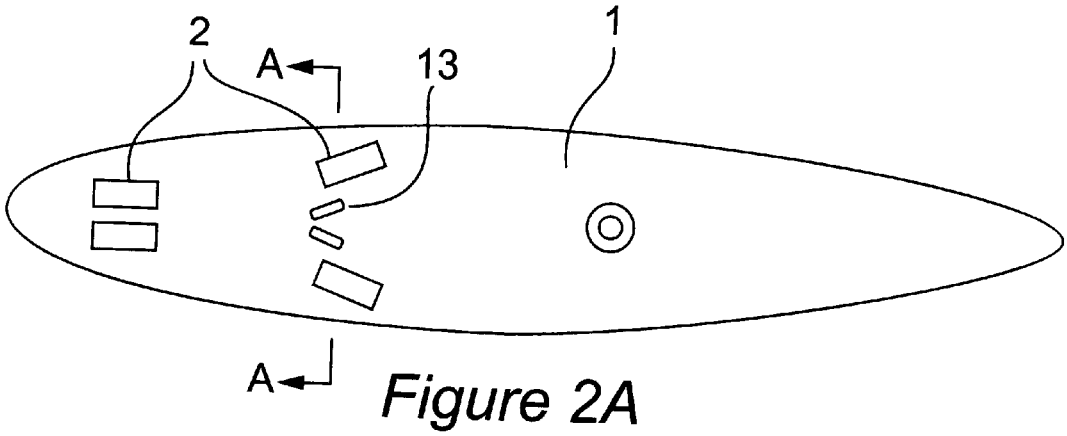
FIGS. 2A, 2B and 2C are top, side (with cross-section) and bottom views, respsectively, of a sailboard in accordance with a first embodiment of the invention having one second planing surface.
Figure 2B:
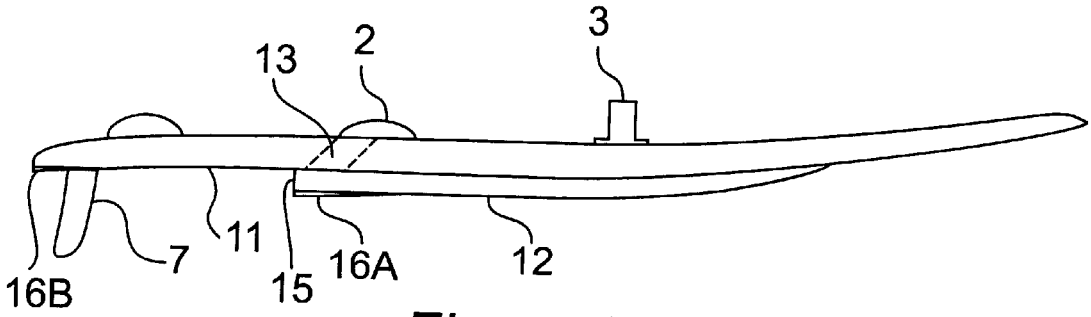
Figure 2C:
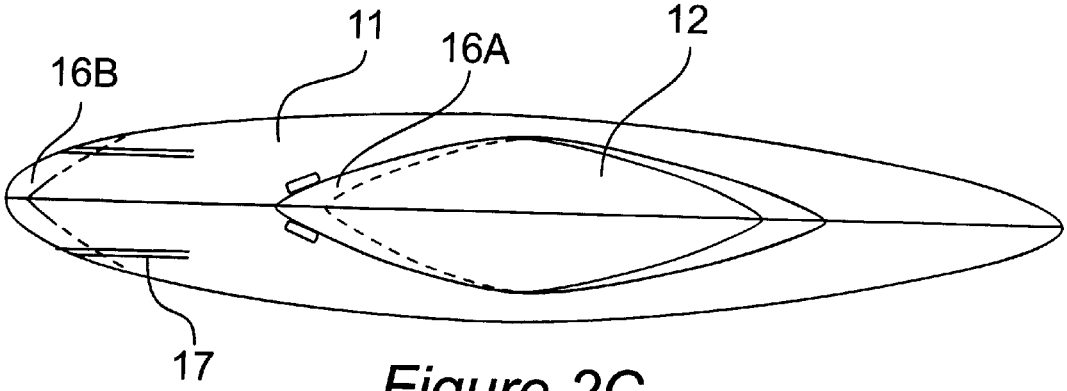
Figure 2D:
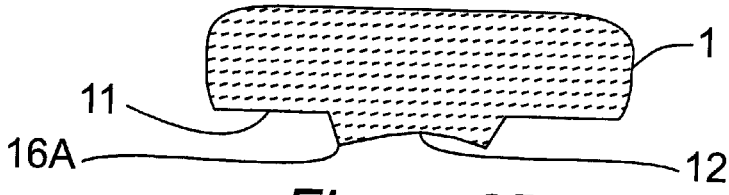

FIGS. 2A–2C illustrate a first embodiment of the invention having a second planing layer or surface feathered in to the bottom surface of the board. The top surface is substantially the same as in FIG. 1A including foot straps 2 and mast foot 3 except for the inclusion of vents 13 which will be discussed in greater detail below. For clarity, the rocker is illustrated as similar to that of FIG. 1B but may be varied substantially without departing from the basic principles of the invention. Similarly, fin 7 is depicted as similar to that of FIGS. 1B and 1C but may be varied and, in any event, the particular shape, area and other features thereof are unimportant to the invention.

Accordingly, planing surface 11 may be regarded as substantially the same as that of FIGS. 1B and 1C but has a second planing surface 12 protruding downwardly therefrom as is particularly evident from the cross-section included in FIG. 2B. The front end of surface 12 is faired or feathered in to the surface 11 at the front end thereof but forms a step 15 at the rear. Even though surface 12 is elongated front-to-rear and substantially streamlined, the inventor has discovered and experimentally confirmed that even streamlined steps such as step 15 cause suction and drag in the region immediately behind the step when the hull is in motion on the water unless the step is vented. This suction may be substantially greater than may be evident from a drawing such as FIG. 1C since, in a sail-powered vessel, there will inevitably be some side-slip or difference between the axis of the hull and the direction of water flow unless the hull is sailed directly before (e.g. in exactly the same direction as) the wind.

Accordingly, vents 13 are provided on opposite sides of surface 12 at the rear thereof adjacent step 15 and allow air to be pulled in behind the step 15 to eliminate the suction and drag. This air also mixes with the water and the fine bubbles thus formed further reduces the skin drag on surface 11. Any number and/or configuration of vents may be used and the vents may be covered by more or less open webbing or perforated sheet material at the top and/or bottom surfaces as may be desired. While webbing or perforated sheet material on the top surface may be largely cosmetic, webbing or, preferably, perforated sheet material which is also relatively rigid on the bottom side of the vents may reduce turbulence of the flow of water and enhance mixing of water and air; both of which tend to further reduce drag beyond the elimination of suction at the step 15.

While some streamlining of surface 12 is considered desirable and of substantial importance to the development of the meritorious effects of the invention, it should be understood that such streamlining is not at all critical thereto and may be widely varied to adjust hull behavior within the basic principles of the invention. For example, if the front and rear ends of surface 12 are kept more parallel over a greater length than is shown in FIG. 2B, the effect of a "shoe keel" to limit sideslip may be somewhat enhanced. Planing may also be enhanced by increase of the area of surface 12 toward the rear with a more abruptly tapered or squared off shape.

It should be appreciated that the surface 12 presents a much smaller wetted area when planing than surface 11 of FIG. 1C. Therefore, the provision of the additional planing surface 12 can provide a shorter and wider surface favoring planing while surface 11 is more long and narrow favoring performance in the displacement mode. At the displacement/planing transition, vents 13 avoid drag due to step 15 while further reducing drag (by air-water mixing) and power requirements to achieve planing.

Therefore, it is seen that the provision of a second planing surface in accordance with the invention allows decoupling of design considerations for operation in the displacement and planing modes and higher performance to be achieved in each; thus accommodating a wider range of wind and water conditions. Venting of the step greatly smooths the displacement/planing transition and allows planing to be achieved in lighter winds and, further, allowing exploitation of virtual wind for much increased speed with much less power.

As a further perfecting feature of the embodiment of FIGS. 2A–2C, surface 12 can be slightly shaped downwardly as shown at 16*a* of FIGS. 2B and 2C. This shaping to form a slight downward concavity or cusp tends to increase the angle of attack at the end of the surface and to increase lift while planing. Since this region is close to the center of gravity of the board, fore and aft pitching or porpoising, as described above, is not engendered. Limitation of angle of attack at the displacement/planing transition can also be limited by similar shaping at 16*b* to further limit the power required to achieve planing. Surface 16*b* will then increase lift to drag ratio when planing is achieved and porpoising does not occur due to the stability of attack angle produced by surface 12. These cusps or other trim adjusting arrangements require no control by the operator and yet provide negative rocker, effectively flattening the hull and reducing drag, as speed increases thus effectively increasing the range of conditions over which high and enhanced performance can be achieved.

Such structures cannot be provided or such effects achieved in regard to a single bottom surface of the hull without causing porpoising effects and increase of criticality of conditions to performance. However, since the invention provides two different bottom surfaces ending at different locations, such shaping can be employed to simultaneously increase lift and reduce drag both while planing and within the displacement/planing transition.

As further perfecting features of the invention, may also be shaped in the lateral direction as shown in FIG. 2C and/or ridges or grooves 17 can be provided to increase the effective aspect ratio of surfaces 11 and/or 12 and further limit side slip. The effective increase in aspect ratio also increases the lift to drag ratio to further increase speed for given wind and water conditions.

Figure 3A:
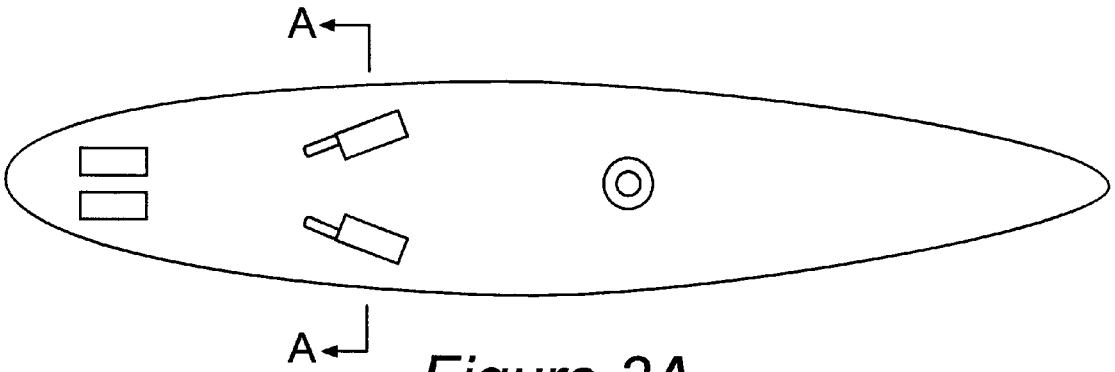
FIGS. 3A, 3B and 3C are top, side (with cross-section) and bottom views, respsectively, of a sailboard in accordance with a first embodiment of the invention including a tunnel or groove in the second planing surface.
Figure 3B:
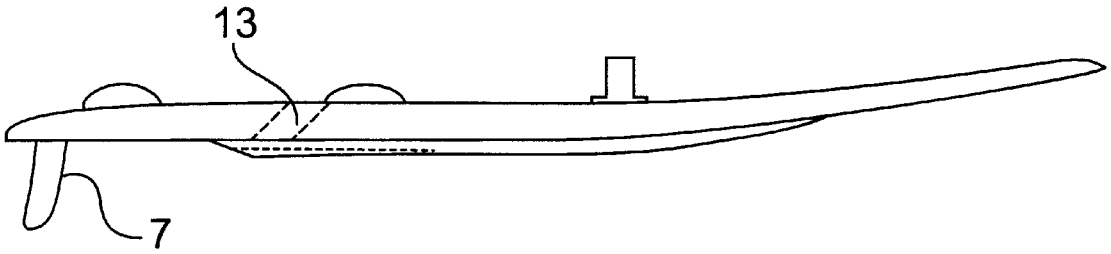
Figure 3C:
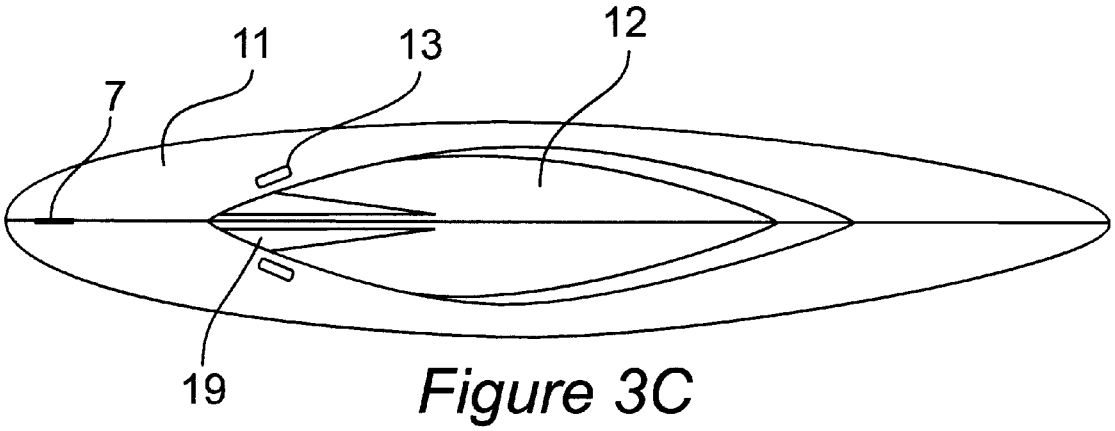
Figure 3D:
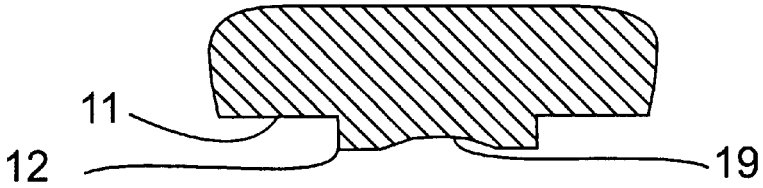

Referring now to FIGS. 3A–3C, a variant form and further perfecting feature of surface 12 is shown. Specifically, a groove 19 is provided to partially or completely fair the central region of surface 12 back to surface 11. Functionally, the depth of groove 19 should be such that when the hull/board is planing at an angle of 2° to 3°, no portion of the second planing surface 12 which is directly in front of fin 7 will be below the level where the fin 7 meets the surface 11 of the board. This effect further functions to limit side slip by increasing the area of lateral surfaces and, more importantly, reduces or prevents cavitation of the fin in the water and thus avoids drag and spinout (when the fin cavitates) that would otherwise occur.

Figure 4A:
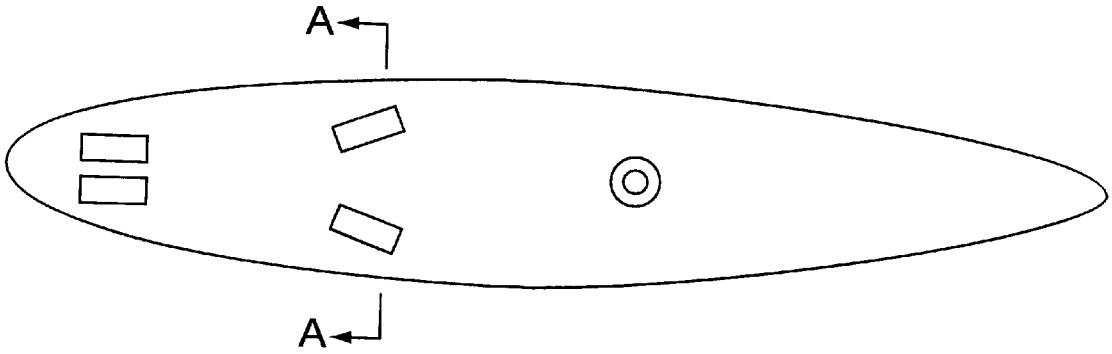
FIGS. 4A, 4B and 4C are top, side (with cross-section) and bottom views, respsectively, of a sailboard in accordance with a first embodiment of the invention having two second planing surfaces feathered in to the first planing surface.
Figure 4B:
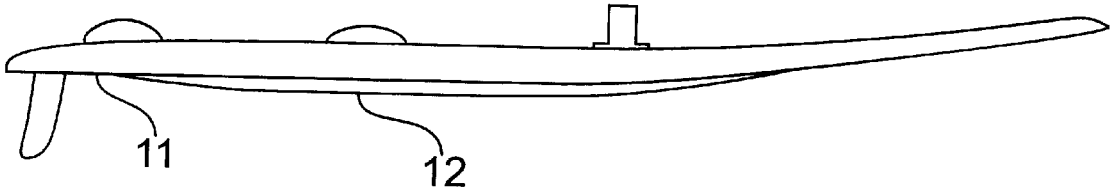
Figure 4C:
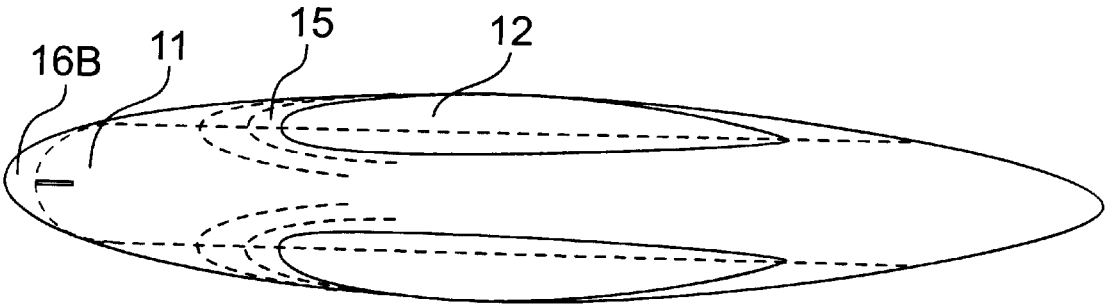
Figure 4D:
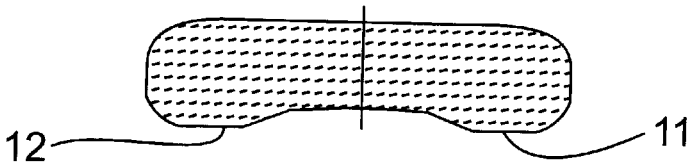

A variant form of the invention is shown in FIGS. 4A–4C in which two surfaces 12 are provided and the step 15 has been feathered out or faired in to the surface 11. In such a case, it is somewhat less important to ventilate the juncture of surfaces 11 and 12 with vents 13 but some performance improvement will be achieved if such vents are provided. This variant form of the invention may be regarded as a simplification of the embodiment of FIGS. 2A–2C and is somewhat more suited to operation for a greater percentage of time in a non-planing mode or non-planing conditions. The vertical distance between the surfaces 11 and 12 is preferably greater than one-half inch (the size of the step of the PRO-tech C. A. T. board alluded to above) and more preferably in the range of 1.0 to 2.5 inches to maintain a good angle of attack and stability thereof. Side-slip is limited by the increased lateral area surrounding surfaces 12 and the recess area 11 between areas 12 improves directional control which may or may not be considered desirable.

Figure 5A:
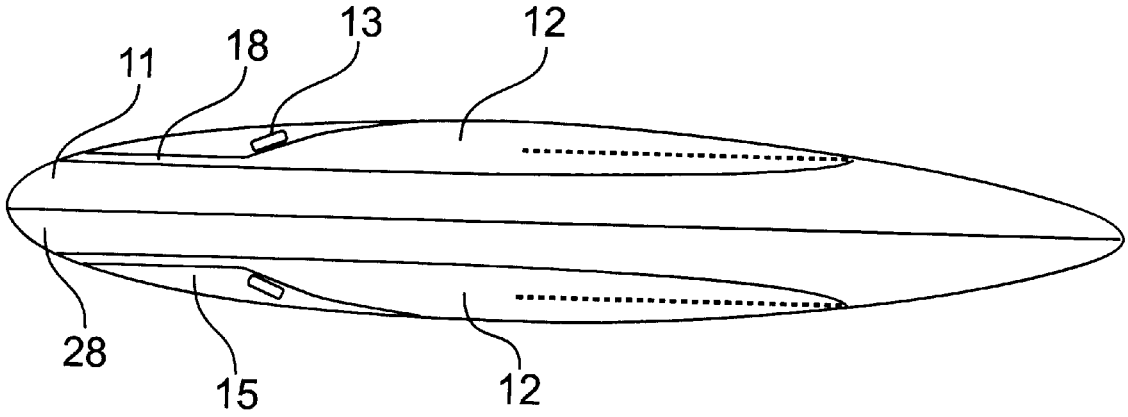
FIGS. 5A, 5B and 5C are bottom views (with cross-section in FIG. 5B) of sailboard hulls in accordance with variant embodiments of the invention having two second planing surfaces feathered in to the first planing surface.
Figure 5B:
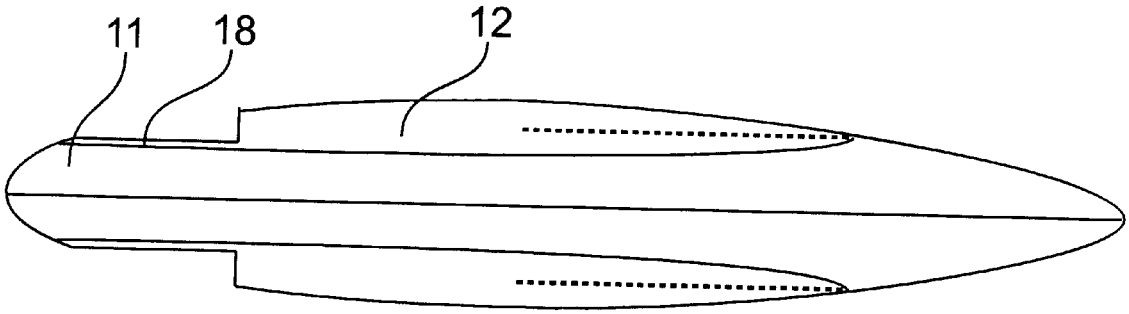
Figure 5C:
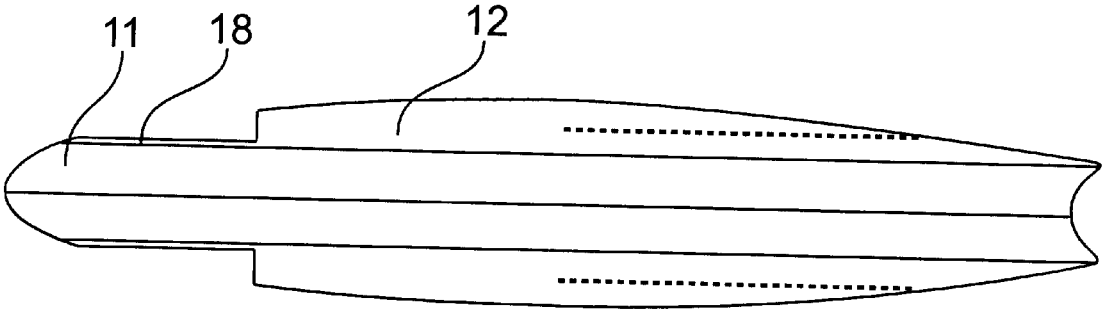

FIGS. 5A–5C show further variant forms of the invention corresponding to the embodiment of FIGS. 4A–4C but including some features generally corresponding to the embodiment of FIGS. 2A–2C or additional perfecting features. FIG. 5A shows that two or more surfaces 12 can be provided and that ridges 18 may be used to form tunnel 28. A third surface 12 may be added centrally of the hull and/or additional surfaces 12 may be added in pairs. Surfaces 12 and 18 may be blended to form a more streamlined shape or squared off more nearly perpendicular to the hull axis, as shown in FIG. 5B. It is preferred to include vents 13, as shown, at step 15. Also, as shown in FIGS. 5B and 5C, step 15 may be fully ventilated by a vent that penetrates to (e.g. FIGS. 5B and 5C) or through (e.g. FIG. 2C) the top of the board or to the side of the board where the step extends above the water line (as shown in FIG. 2C or 5A which may be supplemented by vents through the board, if desired). It is also possible to add additional steps 15 along the length of surfaces 12 and any or all of such steps may be shaped with cusps 16*a*. Cusp shape 16*b* can also be included on surface 11.

Tunnel 28 also provides additional air and water lift and the forward region may be truncated as shown in FIG. 5C to reduce the likelihood that the hull will become airborne except when intended. Softer riding in chop will be achieved if the front ends of surfaces 12 are slightly V-shaped as illustrated by dotted lines in FIG. 5C.

Figure 6A:
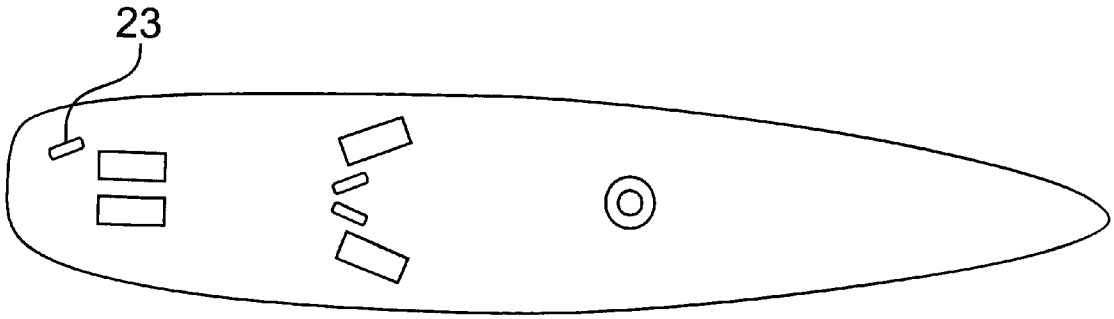
FIGS. 6A, 6B and 6C are top, side and bottom views, respsectively, of a sailboard in accordance with a first embodiment of the invention having two additional planing surfaces.
Figure 6B:
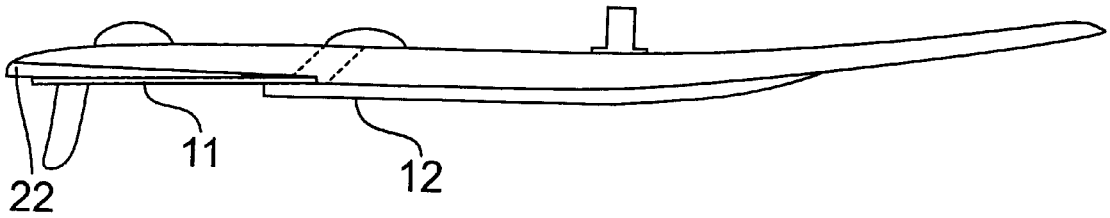
Figure 6C:
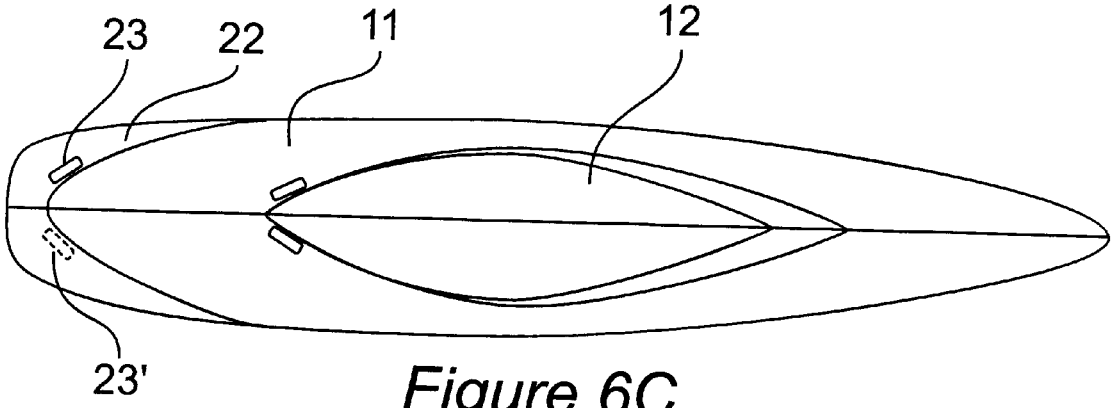

FIGS. 6A–6C illustrates the perfecting feature of providing a further planing surface 22 recessed from surface 11 by a small step which is also preferably vented by vent 23. Pural vents such as 23' can be symmetrically or asymmetrically provided. Surface 22 provides additional lift by both buoyancy and planing at low wind when more lifting surface is generally desirable and further extends the range of conditions under which high performance can be achieved. However, surface 22 has a smaller attack angle or is short enough that in higher wind it is lifted out of the water. In addition, when surface 22 is out of the water, the position of the net lifting force will move forward, thus stabilizing the attack angle at an optimum value over an increased range of speeds and achieving a larger planing surface at low speeds.

In view of the foregoing, it is seen that the invention provides for enhanced performance over a much wider range of wind and water conditions than has heretofore been possible. Further, the displacement/planing transition is made much less difficult and planing operation can be achieved with much lower power than with other designs. Angle of attack is stabilized at near optimum values over a wide range of hull speeds.

While the invention has been described in terms of a single preferred embodiment, those skilled in the art will recognize that the invention can be practiced with modification within the spirit and scope of the appended claims.

What is claimed is:

1. A sailboard hull comprising:

apparatus for attaching a sail mast, apparatus for attaching foot straps, a fin for resisting lateral force of a sail, first planing surface, a second planing surface extending below said first planing surface and forming a step at a juncture of said first planing surface and a rear portion of said second planing surface wherein said second planing surface includes a groove aligned with a fin extending from said first planing surface, and means for reducing suction behind said second planning surface.

2. A sailboard hull as recited in claim 1, wherein said means for reducing suction comprises a vent.

3. A sailboard hull as recited in claim 2, wherein said vent extends through a top surface of said sailboard hull.

4. A sailboard hull as recited in claim 2, wherein said vent extends to a side of said sailboard hull above the surface of water supporting said sailboard hull.

5. A sailboard hull as recited in claim 1, wherein said means for reducing suction includes streamlining of said second surface.

6. A sailboard hull as recited in claim 1 wherein said second planing surface has a shape differing from said first planing surface.

7. A sailboard hull as recited in claim 1, wherein said second planing surface includes a cusp shaped region.

8. A sailboard hull as recited in claim 7, wherein said first planing surface includes a cusp shaped region.

9. A sailboard hull as recited in claim 1, wherein said first planing surface is located principally in front of said fin.

10. A sailboard hull as recited in claim 2, wherein said vent is configured to substantially eliminate suction behind said second planing surface.

11. A sailboard hull comprising:

apparatus for attaching a sail mast, apparatus for attaching foot straps, a fin for resisting lateral force of a sail, a first planing surface, a plurality of second planing surfaces extending below said first planing surface and forming a step at a juncture of said first planing surface and a rear portion of said second planing surface including ridges extending from an end of said second planing surfaces along and below said first planing surface, and means for reducing suction behind said second planing surfaces.

12. A sailboard hull as recited in claim 11, wherein said ridges form a tunnel.

13. A sailboard hull as recited in claim 11, wherein said second planing surface extends more than one half inch below said first planing surface.

14. A sailboard hull as recited in claim 11, wherein said second planing surface extends in the range of 1.5 to 2.5 inches below said first planing surface.

15. A sailboard apparatus as recited in claim 11 wherein said first planing surface is located principally in front of said fin.

16. A sailboard apparatus as recited in claim 11, wherein said means for reducing suction is configured to substantially eliminate suction behind said second planing surface.

17. A sailboard hull as recited in claim 11, wherein said means for reducing suction comprises a vent.

18. A sailboard hull as recited in claim 17, wherein said vent extends through a top surface of said sailboard hull.

19. A sailboard hull as recited in claim 17, wherein said vent extends to the side of said sailboard hull above the surface of water supporting said sailboard hull.

20. A sailboard hull as recited in claim 11, wherein second planing surface includes a cusp shaped region.

21. A sailboard hull as recited in claim 20, wherein said first planing surface includes a cusp shaped region.

* * * * *